US006969947B2

(12) United States Patent
Li et al.

(10) Patent No.: US 6,969,947 B2
(45) Date of Patent: Nov. 29, 2005

(54) LEAD FREE BASE LOCKING MECHANISM

(75) Inventors: Jianwu Li, Solon, OH (US); Bradley R. Karas, Vienna, WV (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/914,392

(22) Filed: Aug. 9, 2004

(65) Prior Publication Data

US 2005/0169016 A1 Aug. 4, 2005

Related U.S. Application Data

(63) Continuation-in-part of application No. 10/677,768, filed on Oct. 2, 2003, which is a continuation of application No. 09/606,387, filed on Jun. 29, 2000, now abandoned.

(51) Int. Cl.[7] ..... H01J 5/48

(52) U.S. Cl. ..... 313/318.09; 313/318.04; 313/318.1; 313/318.01; 445/27

(58) Field of Search ..... 313/318.01, 318.03, 313/318.04, 318.05, 318.09, 51; 439/611, 439/615; 445/27

(56) References Cited

U.S. PATENT DOCUMENTS

| | | | |
|---|---|---|---|
| 1,049,070 | A | 12/1912 | Fowler |
| 1,262,936 | A | 4/1918 | Fowler |
| 2,028,884 | A | 1/1936 | Thomas |
| 2,142,072 | A | 12/1938 | Asmussen et al. |
| 2,157,051 | A | 5/1939 | Birdseye |
| 5,006,751 | A | 4/1991 | Marshall |
| 5,381,070 | A | 1/1995 | Tuttle et al. |
| 5,521,460 | A | 5/1996 | Zhu |

FOREIGN PATENT DOCUMENTS

| | | |
|---|---|---|
| EP | 0 599 624 | 6/1994 |

*Primary Examiner*—Mariceli Santiago
*Assistant Examiner*—Anthony Perry
(74) *Attorney, Agent, or Firm*—Fay, Sharpe, Fagan, Minnich & McKee, LLP

(57) ABSTRACT

A lamp that utilizes a lamp base locking ring to secure a lamp base shell to a lamp. A hollow light transmitting body terminates in a neck that includes threads and a keyway. A lamp base locking ring having an indentation that extends into the keyway is disposed around the circumference of the neck. A lamp base shell is threaded onto the threads of the neck. The lamp base shell is mechanically fastened to the lamp base locking ring to secure the lamp base shell to the hollow light transmitting body.

18 Claims, 6 Drawing Sheets

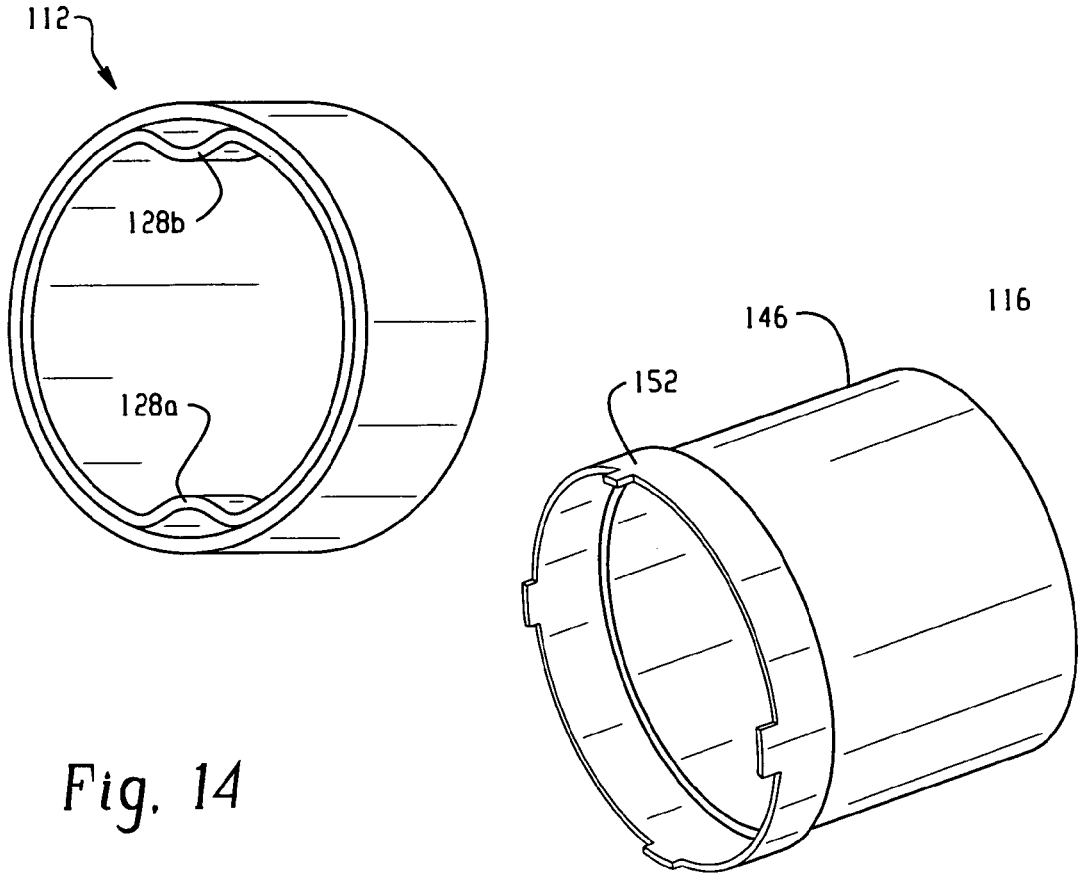
Fig. 14
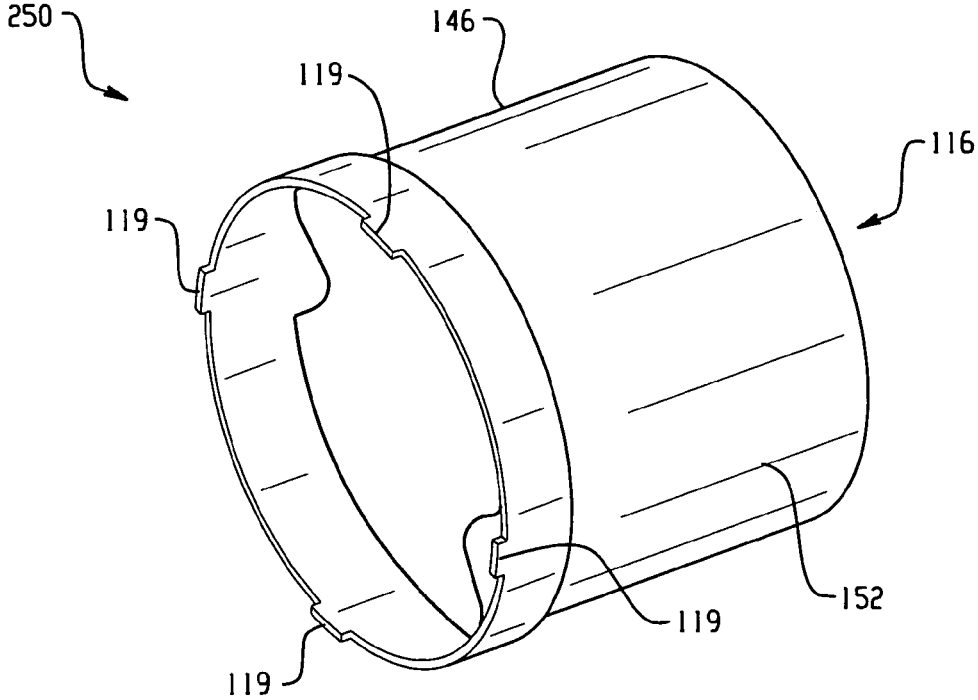

LEAD FREE BASE LOCKING MECHANISM

CROSS-REFERENCE TO RELATED APPLICATIONS

This application is a continuation-in-part application of Ser. No. 10/677,768 filed on Oct. 2, 2003, the details of which are incorporated herein by reference, which is a continuation application of Ser. No. 09/606,387 filed on Jun. 29, 2000, now abandoned.

BACKGROUND OF THE INVENTION

The present invention relates generally to lamps, and in particular, to a lamp that utilizes a lead free lamp base locking ring to secure a lamp base shell to the light source, lamp, or bulb, which eliminates the need for lead solder and/or welding to mechanically hold the base to a light transmissive envelope (also referred to as a body or bulb).

It is common in the art to use lamp base shells to facilitate insertion and removal of a lamp into a corresponding lamp socket to establish electrical contact between the conductors of the lamp and the socket. Several structures have been developed to prevent the lamp base shell from being separated from the lamp base. See, for example, U.S. Pat. Nos. 1,262,936; 2,028,884; 2,157,051 and 5,006,751.

One method of securing a lamp base shell to a lamp utilizes a threaded inner shell having a washer-like base and a plurality of orthogonally projecting tabs around the periphery of the base to secure the lamp base shell to the lamp. The tabs of the inner shell each have a dimple that corresponds with an indentation in the neck of the lamp. The inner shell is secured to the lamp base by placing it over the neck until the corresponding dimples and indentations are aligned. Once the inner shell is in place, a lamp base shell is securely screwed onto the inner shell and is staked to engage the lamp base shell with the inner shell. This configuration requires expensive parts and involves difficult assembly.

Another method used to mechanically secure a base shell to a lamp employs a threaded form molded into the lamp glass with a keyway to accommodate a lead solder preform that is used to make an electrical connection to one of the lamp leads and to lock the base onto the lamp. Although this method provides sufficient back out torque resistance and addresses deficiencies of the inner shell technique, the use of lead solder has several disadvantages. Environmental laws and regulations continue to impose increasingly stringent standards that force the lamp industry to phase-out use of lead solder. Additionally, lead solder discolors the base shells of the lamps.

U.S. Pat. Nos. 5,381,070 ('070 patent) and U.S. Pat. No. 5,521,460 ('460 patent) disclose lamp base locking clips. The lamp base locking clip of the '070 patent includes a plate having a lip that extends outward on one end and has a flat portion on the opposite end. The locking clip is captured in a keyway formed on the glass neck of the lamp body. One of the lamp lead wires is welded to the flat portion of the clip and a rim on the lamp base shell is welded to the outwardly extending lip of the locking clip to form a lamp base assembly that does not include lead based solder.

The lamp base locking clip of the '460 patent has first and second ends of a given thickness and an intermediate portion that is at least approximately three times the thickness of the first and second ends. The lamp base locking clip is positioned in a keyway and connected to one lead in wire and the lamp base shell to secure the lamp base shell.

Another method used to secure a base shell to a lamp employs cement. The cost of cement is high and an expensive oven is required to cure the cement. It is financially unpractical for automated production.

And still a further method for securing a base shell to a lamp involves use of a "punching" step. The current method involves "punching" on the threads of the lamp base shell and an inner shell. The cost of the inner shell is significant and it is not efficient to automated production. The "punching" deforms the thread on the lamp base shell which causes difficulty when screwing the lamp into the socket.

Accordingly, a need exists for a low cost lead-free base, particularly for selected lamps such as HID lamp bases, which can be efficiently implemented in automated production.

BRIEF DESCRIPTION OF THE INVENTION

The present invention concerns a lamp. The lamp includes a hollow light transmitting envelope or body, a lamp base locking ring, and lamp base shell. The hollow light transmitting body includes a light source that includes first and second leads that extend from a neck of the hollow light transmitting body. The body terminates in the neck that is substantially circular in cross-section. The neck includes a keyway formed therein that is parallel to the longitudinal axis of the neck and includes external threads about the circumference of the neck. The lamp base locking ring is disposed around the circumference of the neck. The locking ring includes an indentation that extends inward from an outer diameter of the locking ring. The indentation fits into the keyway in the neck that inhibits relative rotation between the locking ring and the neck. The lamp base shell has internal threads that are threaded onto external threads of the neck. The lamp base shell is mechanically fastened to the lamp base locking ring to inhibit movement of the lamp base shell with respect to the neck. The lamp base shell includes first and second electrically conductive portions that are electrically connected to corresponding first and second leads of the light source.

The locking ring may include one or more projections for fastening the locking ring to the lamp base shell. The one or more projections of the lamp base locking ring allow the lamp base locking ring to be assembled to the lamp base shell before the lamp base shell and the lamp base locking ring are assembled to the lamp. In this embodiment, the locking ring is rotatably connected to the lamp base shell. The lamp base assembly including the lamp base ring may be threaded onto threads of the neck, because of the rotational freedom of the locking ring with respect to the lamp base shell.

A lamp of the present invention is fabricated by inserting the neck of a lamp body into a locking ring, such that a locking ring indentation extends into a keyway. Internal threads of the lamp base shell are threaded onto the threads of the lamp neck. The locking ring is mechanically fastened to the lamp base shell to inhibit movement of the lamp base shell with respect to the neck. The fastening of the locking ring to the lamp base shell may be accomplished by spot welding, resistance welding or plasma welding. When the locking ring includes a projection, it may be bent over an open end of the lamp base shell to ease connection of the locking ring to the base shell. Also, when the locking ring includes one or more projections, the locking ring and lamp base shell may be assembled prior to being assembled to the lamp, such that the lamp base shell and the locking ring can rotate with respect to one another.

A lamp of the present invention comprises a hollow light transmitting body including a light source. The body terminates in a neck and the neck is substantially circular in cross section including a longitudinal axis and a circumference. The neck includes a keyway formed in the neck parallel to the longitudinal axis and includes external threads about the circumference. The light transmitting body comprises first and second leads extending from the neck of the body. A lamp base locking ring is disposed around the circumference of the neck. The locking ring comprises an inner ring and an outer ring, the inner ring is connected to the outer ring and has an indentation extending inward away from the outer ring. The indentation fits into the keyway for inhibiting rotative movement of the locking ring about the neck. A lamp base shell is provided having internal threads in communication with the external threads of the neck. The lamp base shell is mechanically fastened to the lamp base locking ring to inhibit movement of the lamp base shell with respect to the neck. The lamp base shell includes first and second electrically conductive portions. The first lead is electrically connected to the first electrically conductive portion of the shell and the second lead is electrically connected to the second electrically conductive portion of the shell. The lamp base shell includes internal threads for engagement of the threads of the neck. The lamp base shell has first and second electrically conductive portions for connection of the first and second leads. A locking ring is rotatively connected to the lamp base shell. The locking ring is sized to fit around the neck. The locking ring includes an inner portion and an outer portion. The inner portion includes a notch extending inward from the outer portion thereby creating an aperture therebetween.

A method of securing a lamp base shell to a lamp includes inserting a neck of the lamp having threads and a keyway into a locking ring having an indentation on an inner portion that corresponds with the keyway. The method includes the further step of threading the internal threads of the lamp base shell onto the threads of the neck. Staking the lamp base shell to an outer portion of the locking ring adjacent to the indentation inhibits movement of the lamp base shell with respect to the neck.

A lamp constructed in accordance with the present invention eliminates the need for lead solder to secure the lamp base shell to the lamp. Additionally, the use of a locking ring eases assembly of the lamp base shell to the lamp because the movement of the locking ring with respect to the lamp base shell is limited by the keyway as the lamp base shell is threaded onto the threads of the neck.

The present invention provides a low cost lead free lamp base for locking the base to a bulb.

The present invention provides a low cost lead free lamp base which can be locked to the base of a bulb in an efficient automated production.

Additional features of the invention will become apparent and a fuller understanding obtained by reading the following detailed description in connection with the accompanying drawings.

BRIEF DESCRIPTION OF THE DRAWINGS

FIG. 14 is an exploded view of the locking ring according to the second embodiment assembled to another variety of lamp base shell assembly.

DETAILED DESCRIPTION OF THE INVENTION

Figures 1A, 1B, 1C:
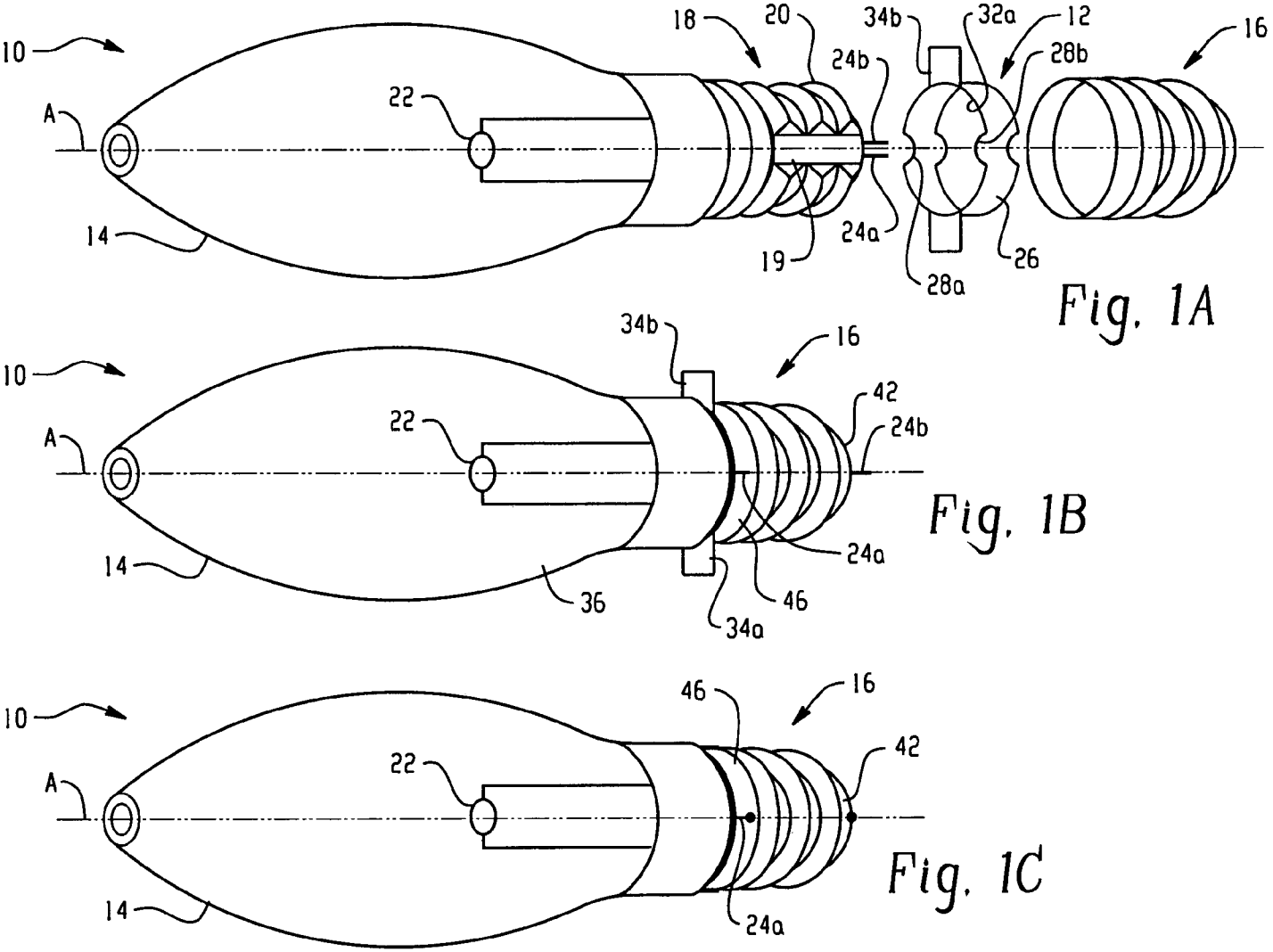
FIG. 1A is a perspective view of a hollow light transmitting body, a lamp base locking ring and a lamp base shell.
FIG. 1B is a perspective view of a hollow light transmitting body, with a lamp base locking ring and a lamp base shell disposed around a neck of the hollow light transmitting body.
FIG. 1C is a perspective view of a lamp constructed in accordance with the present invention.
Figure 6:
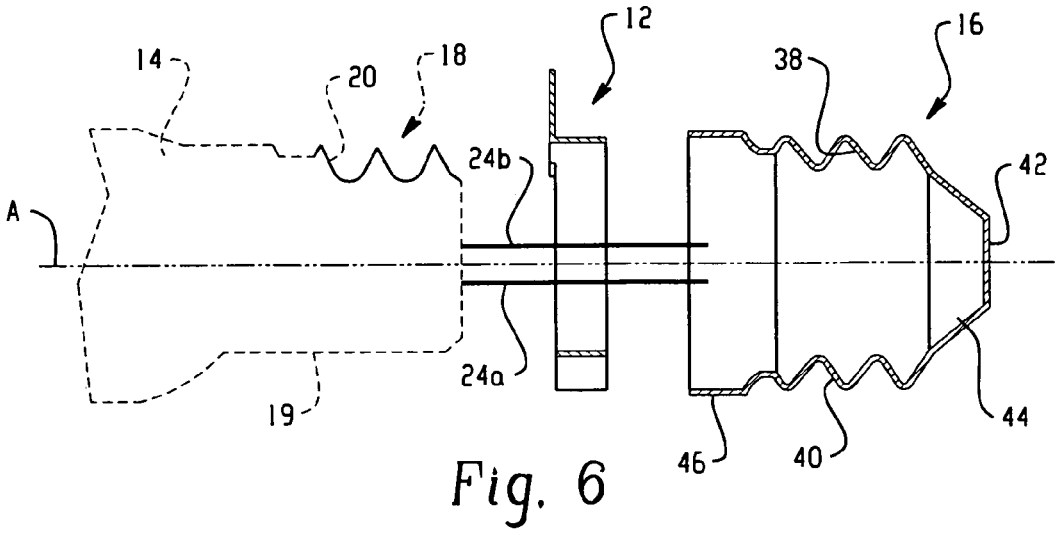
FIG. 6 is an exploded sectional view taken across line 3—3 of FIG. 2 of a lamp base locking ring and a lamp base shell being assembled to a hollow light transmitting body.

The present invention is directed to a lamp 10 which uses a lamp base locking ring 12 to connect a hollow light transmitting envelope or body 14 to a lamp base shell 16. The hollow light transmitting body 14 or bulb terminates in a neck 18. The neck is substantially circular in cross-section and has a longitudinal axis A and a circumference. Referring to FIG. 1A, the neck includes external threads 20 for attachment of the lamp base shell 16 and two keyways 19 (only one of these keyways is visible in FIG. 1A) that extend along opposite sides of the neck 18 formed in the neck parallel to the axis A. The body 14 includes a light source 22 and first and second leads 24*a*, 24*b*. The light source 22 may be any type of light source. For example, the light source may be a filament, a filament tube, or an arc tube. Referring to FIGS. 1A and 6, the leads 24*a*, 24*b* extend from the neck 18 of the lamp 10 along axis A before the lamp base shell 16 and lamp base locking ring 12 are assembled to the neck 18. Initial placement of such leads is well known in the prior art.

Figure 2:
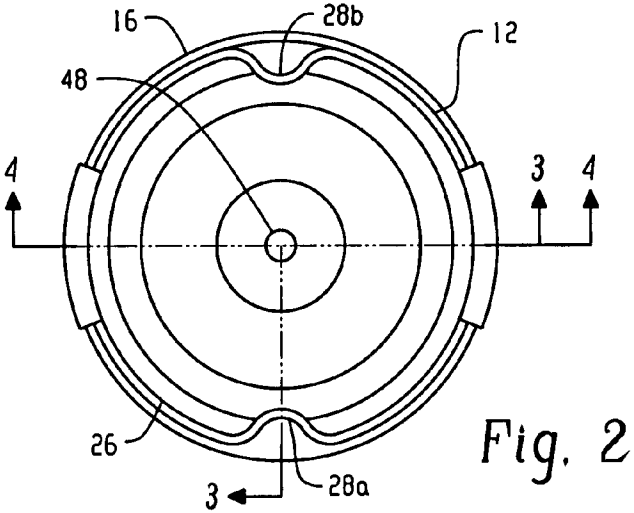
FIG. 2 is a top plan view of a lamp base locking ring rotatably connected to a lamp base shell.

Referring to FIGS. 1A and 2, the lamp base locking ring 12 of one embodiment is made from a band of material that is formed into a circular ring 26. In this embodiment, two indentations 28*a*, 28*b* extend inward from the outer diameter of the circular ring 26. The indentations 28*a*, 28*b* correspond to the keyways 19 in the neck 18 of the hollow light transmitting body 14. Extending from a first end 32*a* of the circular ring portion 26 are two projections 34*a*, 34*b* that extend radially outward from the circular ring portion 26 before the lamp base locking ring 12 is assembled to the lamp base shell 16. In this embodiment, the indentations 28*a*, 28*b* are diametrically opposed. The projections 34*a*, 34*b* are also diametrically opposed and are at an angle of approximately ninety degrees from the first and second indentations 28*a*, 28*b*. The lamp base locking ring 12 of the present invention can be made from virtually any material. For example, the lamp base locking ring 12 may be made from copper, brass, nickel, steel or stainless steel.

Figure 7:
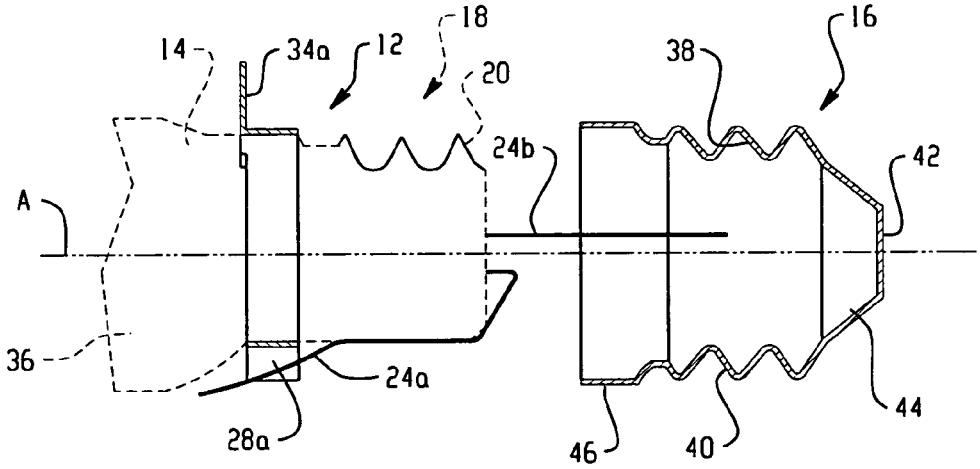
FIG. 7 is an exploded sectional view taken across line 3—3 of FIG. 2 of a lamp base locking ring and a lamp base shell being assembled to a hollow light transmitting body.

Referring to FIGS. 1A, 6 and 7, to assemble the locking ring 12 to the hollow light transmitting body, the indentations 28*a*, 28*b* are aligned with the keyways 19 in the neck 18. The neck 18 and leads 24*a*, 24*b* are inserted through the lamp base locking ring 12. Referring to FIGS. 1B and 7, the lead 24*a* is bent so that it extends through the keyway 19 toward a light emitting end 36 of the hollow light transmitting body 14 past the indentation 28*a* of the lamp base locking ring 12. The lamp base locking ring may be used with many different hollow light transmitting bodies or bulbs. The present invention can be used with virtually any type of hollow light transmitting body or bulb, Examples of acceptable hollow light transmitting bodies or bulbs are Model Numbers ED18, ED28 and ED37 sold by General Electric Company, assignee of the present invention.

Referring to FIG. 7, the lamp base shell 16 has internal threads 38 that correspond with the external threads 20 on the neck 18 of the hollow light transmitting body 14. The lamp base shell 16 comprises a threaded conductive portion 40 that is connected to a conductive end portion 42 by an insulating portion 44. The threads 38 of the lamp base shell 16 extend to a generally cylindrical portion 46 of the lamp base shell 16. The conductive end portion 42 includes a hole 48 (shown in FIG. 2) for the lead 24*b*. The threads 38 of the lamp base shell 16 are threaded onto the external threads 20 on the neck 18 of the hollow light transmitting body 14. The diameter of the cylindrical portion 46 of the lamp base shell 16 is slightly larger than typical lamp base shells, leaving room for the locking ring 12. In another embodiment, the diameter of the cylindrical portion of the lamp base shell 16 is the same as typical lamp base shells and the neck of the bulb is slightly smaller than typical bulbs, leaving room for the locking ring 12. Examples of lamp base shells that may be used or modified in accordance with the present invention are Model Numbers Mog Screw E26, Mog Screw E27 and Mog Screw E39 sold by The General Electric Company, assignee of the present invention.

Figure 8:
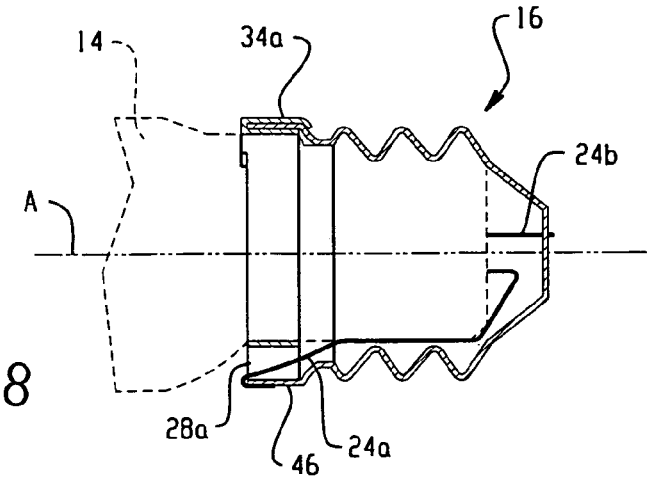
FIG. 8 is a sectional view taken across line 3—3 of FIG. 2 of a lamp base locking ring and a lamp base shell assembled to a hollow light transmitting body.

Referring to FIGS. 1B, 1C and 8, lead 24*a* extends in a keyway 19 towards the light emitting end 36 of the hollow light transmitting body past an indentation 28*a* of the lamp locking ring 12 and out of the lamp base shell 16. The lead 24*b* extends from the neck 18 of the hollow light transmitting body 14 and through the hole 48 in the conductive end portion 42 of the lamp base shell 16.

Referring to FIGS. 1B, 1C and 8, once the lamp base locking ring 12 and lamp base shell 16 are assembled to the neck 18 of the hollow light transmitting body 14, the projections 34*a*, 34*b* and lead 24*a* are bent down against the generally cylindrical portion 46 of the lamp base shell 16 and welded to the lamp base shell. The indentations 28*a*, 28*b* extending inward from the outer diameter of the lamp base locking ring 12 inhibit relative rotational movement of the connected lamp base locking ring 12 and the lamp base shell 16 to prevent the threads 38 of the lamp base shell 16 from being disengaged from the threads 20 of the neck 18 of the hollow light transmitting body 14. In one embodiment, the lamp base shell 16 is spot welded to the lamp base locking ring 12. In another embodiment, the projections 34*a*, 34*b* are resistance welded to the lamp base shell 16. Other connection techniques such as plasma welding may also be employed to connect the projections to the lamp base shell.

Referring to FIGS. 1C and 8, lead 24*a* is welded to the generally cylindrical portion 46 of the lamp base shell 16 and lead 24*b* is welded to the conductive end portion 42 to electrically connect the light source 22 to the threaded conductive portion and conductive end portion of the lamp base shell 16. The leads 24*a*, 24*b* may be spot welded, resistance welded or plasma welded to the base shell 16.

Figure 3:
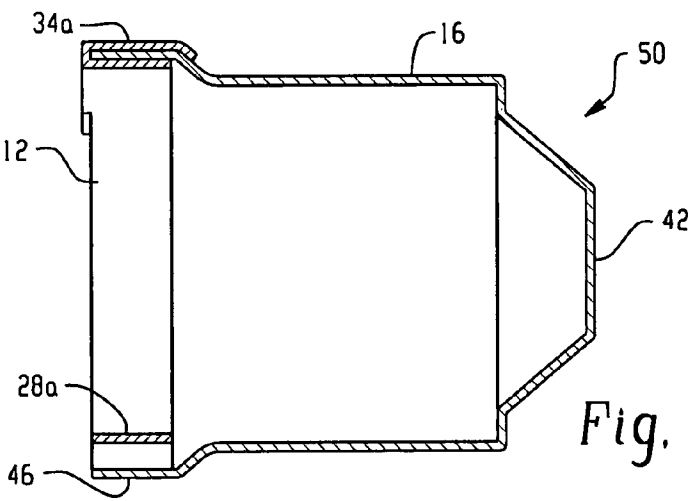
FIG. 3 is a sectional view taken across line 3—3 of FIG. 2.
Figure 5:
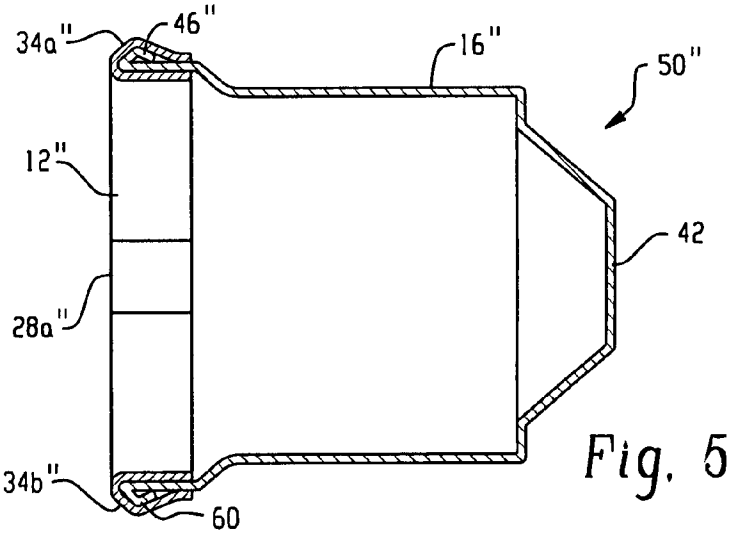
FIG. 5 is a sectional view of a lamp base locking ring and lamp base shell assembly of another preferred embodiment taken across line 4—4 of FIG. 2.
Figure 4:
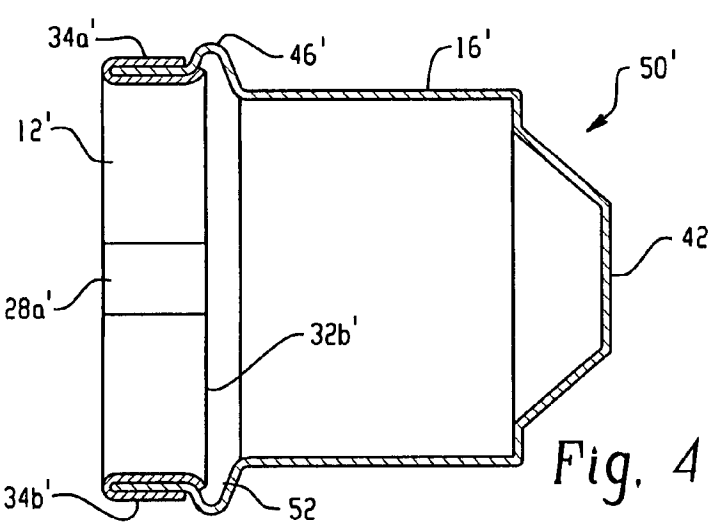
FIG. 4 is a sectional view of a lamp base locking ring and lamp base shell assembly of another preferred embodiment taken across line 4—4 of FIG. 2.

In other embodiments shown in FIGS. 3, 4 and 5, the lamp base locking ring 12, 12', 12" is rotatably connected to the lamp base shell 16, 16', 16" (shown without internal and external threads to simplify the drawing) prior to being installed on the hollow light transmitting body 14 to ease assembly.

In the embodiment shown in FIG. 3, the lamp base locking ring 12 is rotatably connected to the lamp base shell 16 by loosely crimping the projections 34*a*, 34*b* (34*b* not shown) around a generally cylindrical portion 46 of the lamp base shell 16, allowing rotational movement between the lamp base shell 16 and the lamp base locking ring 12.

In the embodiment shown in FIG. 4, the lamp base shell 16' includes a flared out portion 52 around the circumference of the cylindrical portion 46'. The lamp base locking ring 12' is inserted into the generally cylindrical portion 46' of the lamp base shell 16'. The end 32*b'* of the lamp base locking ring 12' is flared into the flared out portion 52 of the lamp base shell 16' and the projections 34*a'*, 34*b'* of the lamp base locking ring 12' are bent down around the generally cylindrical portion 46' of the lamp base shell 16' to rotatably fasten the lamp base locking ring 12' to the lamp base shell 16'.

In the embodiment shown in FIG. 5, cylindrical portion 46" is folded back on itself to form a ridge 60 around the circumference of the cylindrical portion 46" of the lamp base shell 16". The projections 34*a"*, 34*b"* of the lamp base locking ring 12" are loosely crimped over the ridge 60 formed on the cylindrical portion 46" of the lamp base shell 16" to rotatably connect the lamp base locking ring 12" to the lamp base shell 16'.

In each of the embodiments shown in FIGS. 3, 4 and 5, the lamp base locking ring 12, 12', 12" is permitted to rotate with respect to the lamp base shell 16, 16', 16", but is prevented from being removed from the generally cylindrical portion 46, 46', 46" of the lamp base shell 16, 16', 16".

The lamp base locking ring and lamp base shell assembly 50, of any of these embodiments are assembled to the neck 18 of the hollow light transmitting body 14 by first bending lead 24*a* in a keyway 19 of the neck 18 of the hollow light transmitting body 14. The neck 18 may include a separate keyway 19 for the lead 24*a* or a keyway 19 may be large enough for an indentation 28*a*, 28*b* of the locking ring to be disposed next to the lead 24*a* in the keyway 19. The one or more indentations 28*a*, 28*b* of the lamp locking ring 12 are aligned with the one or more corresponding keyways 19 (shown in FIGS. 1A and 6) in the neck 18. The lamp base locking ring and shell assembly 50 is brought into engagement with the threads 20 on the neck 18, while maintaining alignment of the indentations 28*a*, 28*b* with the keyways 19. The lamp base shell 16 is rotated about the neck 18 to move the lamp base locking ring 12 of the lamp base locking ring and shell assembly 50 in the keyways 19 in the neck 18. As the lamp base shell 16 is rotated, the movement of the indentations 28*a*, 28*b* is constrained by the keyways 19 in the neck 18. The rotation of the lamp base shell 16 is continued until the lamp base locking ring and shell assembly 50 is tightly attached to the neck 18 of the hollow light transmitting body 14. Lead 24*a* extends from the lamp base locking ring and shell assembly 50 and lead 24*b* extends through the conductive end portion 42 of the lamp base locking ring and shell assembly 50. In each of the embodiments shown in FIGS. 3, 4 and 5, the lamp base locking ring 12 includes projections 34*a*, 34*b* that are welded to the lamp base shell 16 to prevent relative rotational motion between the lamp base shell 16 and the lamp base locking ring 12 to lock the lamp base locking ring and shell assembly to the hollow light transmitting body. The lead 24*a* is welded to the lamp base shell and lead 24*b* is welded to the conductive end portion 42 of the lamp base shell 16 of the lamp base assembly 50.

Figure 10:
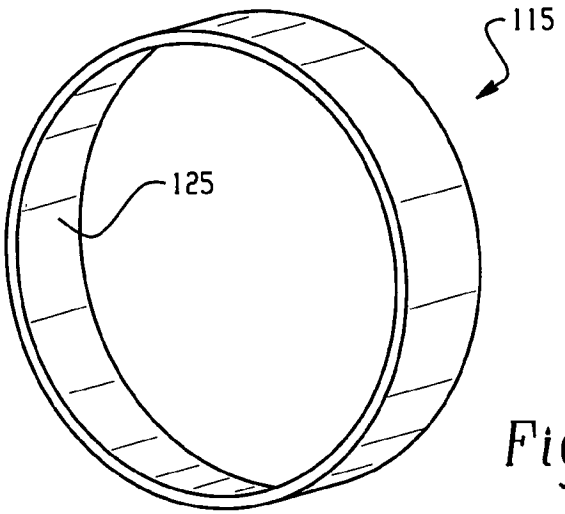
FIG. 10 is a perspective view of an outer ring of the locking ring according to the second embodiment.
Figure 11B:
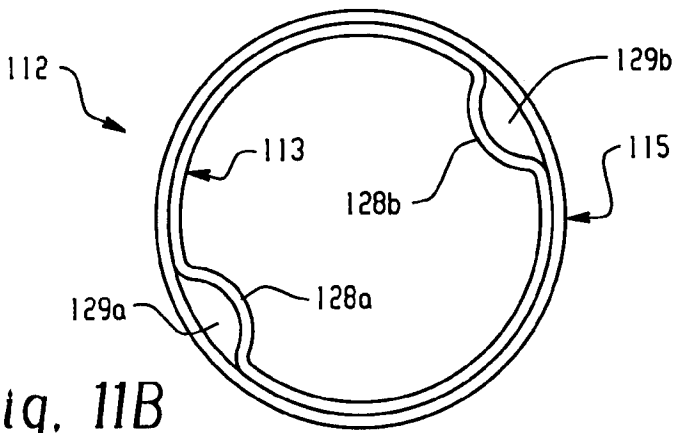
FIG. 11B is an elevation view of the inner ring and outer ring assembly of the second embodiment.
Figure 9:
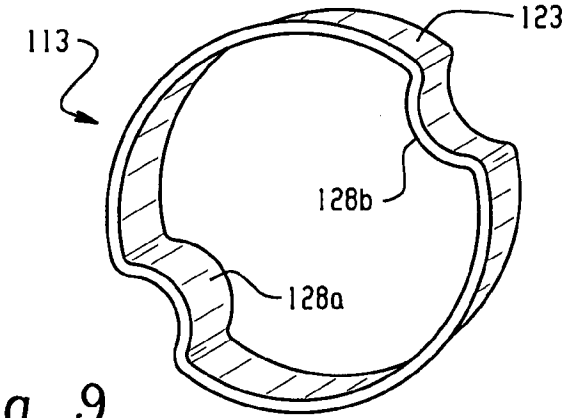
FIG. 9 is a perspective view of an inner ring of a lamp base locking ring according to the second embodiment.
Figure 11A:
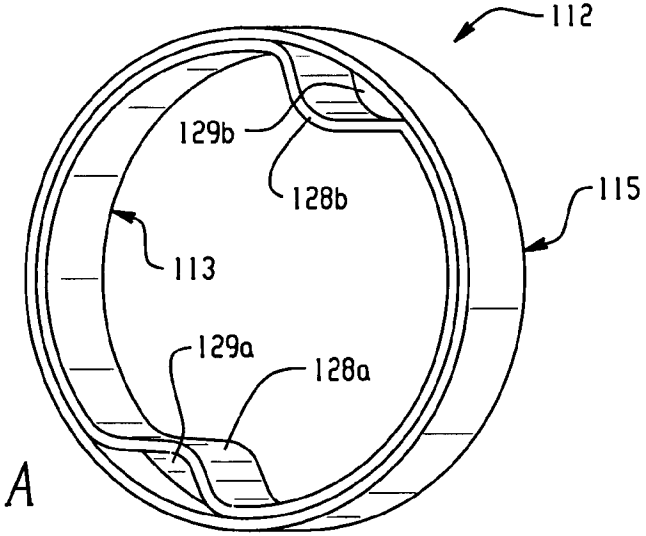
FIG. 11A is a perspective view of the inner ring and outer ring assembly of the second embodiment.

Referring to FIGS. 9–11B, a lamp base locking ring according to another embodiment is made from a band of material that is formed into a lamp base locking ring 112. In this embodiment, first and second notches or indentations 128*a*, 128*b* extend generally radially inward from an inner ring or inner portion 113 (FIG. 9). As will be appreciated, the indentations 128*a*, 128*b* correspond to the keyways 19 in the neck 18 of the hollow light transmitting body 14. The lamp base locking ring 112 is preferably comprised of one or multiple components. One embodiment includes two components: the inner ring 113 (FIG. 9) and an outer ring or outer portion 115 (FIG. 10). The outer ring 115 is a circular shape and can be secured or bonded to the inner ring 113 as one unit or locking ring 112 (FIGS. 11A–11B). The bonding of the inner 113 and outer 115 rings prevents rotation therebetween. Specifically, an outer surface 123 of the inner ring 113 can be mechanically or chemically secured/bonded to an inner surface 125 of the outer ring 115 using, for example, resistance welding, punching, cement, etc. The lamp base locking ring 112 is preferably made of any material that provides the required strength suitable for use with the operating temperature of the lamp. The indentations 128*a*, 128*b* extend inward from the inner surface 125 of the outer ring 115 and form apertures 129*a*, 129*b*.

Figure 12:
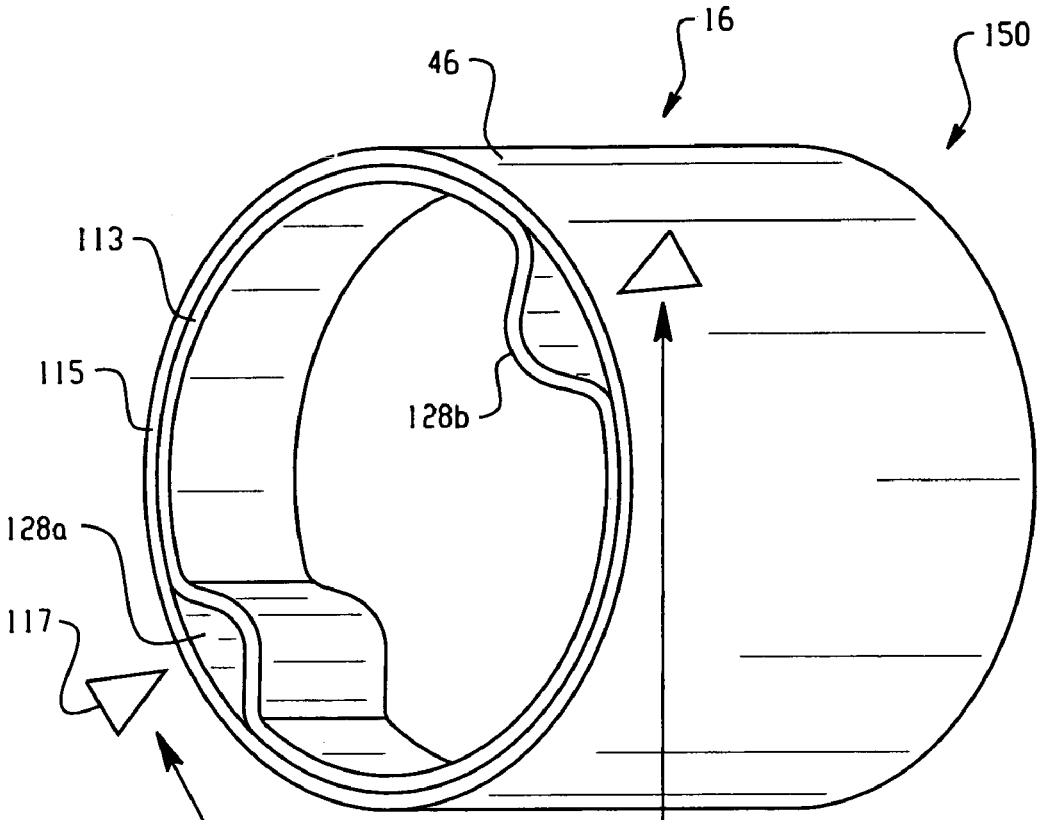
FIG. 12 is a perspective view of the locking ring and a lamp base shell assembly of the second embodiment.
Figure 13:
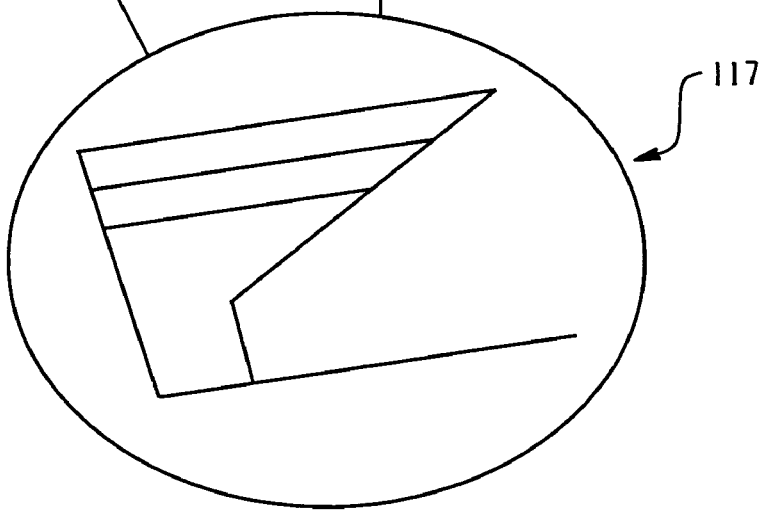
FIG. 13 is an enlarged cross-sectional view of a pierce or stake used for securing the lamp base shell to the outer ring.

To assemble the locking ring 112 and a lamp base shell assembly 150 to the hollow light transmitting body, the indentations 128*a*, 128*b* are aligned with the keyways 19 in the neck 18. The neck 18 and leads 24*a*, 24*b* are inserted through the lamp base locking ring 112. As described above, the lamp base locking ring 112 and the lamp base shell 16 (shown without internal and external threads to simplify the drawing) are assembled to the neck 18 of the hollow light transmitting body 14. Referring to FIGS. 12 and 13, the cylindrical portion 46 of the lamp base shell 16 is preferably pierced or staked 117 to the outer ring 115 of the lamp base locking ring 112. The piercing is done on the cylindrical portion 46 and the outer ring 115, thereby preventing deformation of the threads on the lamp base shell 16 and/or the inner ring 113. The indentations 128*a*, 128*b* extending inward away from the inner surface 125 of the outer ring 115 of the lamp base locking ring 112 inhibit relative rotational movement of the connected lamp base locking ring 112 and the lamp base shell 16 to prevent the threads of the lamp base shell 16 from being disengaged from the threads 20 of the neck 18 of the hollow light transmitting body 14. As described above, the lead wires 24*a*, 24*b* are then welded to the cylindrical portion 46 of the lamp base shell 16 and to the conductive end portion 42 in order to electrically connect the light source 22 to the threaded conductive portion and conductive end portion of the lamp base shell 16.

Referring now to FIG. 14, another method for connecting the locking ring 112 and the hollow light transmitting body 14 includes preassembly of the locking ring 112 with another variety of lamp base shell 116 (shown without internal and external threads to simplify the drawing). As shown in FIG. 14, the lamp base locking ring 112 is connected to the lamp base shell 116 by bending fins 119 inward that secures the components together yet allows relative rotation between these components. The lamp base shell 116 includes a flared out or enlarged diameter portion 152 at one end of the cylindrical portion 146. The lamp base locking ring 112 is inserted into the generally cylindrical portion 146 of the lamp base shell 116. The fins 119 of the lamp base shell 116 are bent inward to retain the lamp base locking ring 112 to the lamp base shell 116 and still allow relative rotation. The lamp base locking ring 112 is permitted to rotate with respect to the lamp base shell 116, but is prevented from being removed from the generally cylindrical portion 146 of the lamp base shell 116 by the deformed fins 119. The one or more indentations 128*a*, 128*b* of the lamp locking ring 112 are aligned with the one or more corresponding keyways 19 and the neck 18. The lamp base locking ring 112 and a shell assembly 250 is brought into engagement with the threads 20 on the neck 18, while maintaining alignment of the indentations 128*a*, 128*b* with the keyways 19. The lamp base shell 116 is rotated about the neck 18 to move the lamp base locking ring 112 of the lamp base locking ring and shell assembly in the keyways 19 in the neck 18. As the lamp base shell 116 is rotated, the movement of the indentations 128*a*, 128*b* is constrained by the keyways 19 in the neck 18. The rotation of the lamp base shell 116 is continued until the lamp base locking ring and shell assembly 250 is tightly attached to the neck 18 of the hollow light transmitting body 14. The flared portion 152, proximal to the apertures 129*a*, 129*b* is then be staked or pierced to the outer ring 115 as described above in connection with FIGS. 12 and 13 in order to prevent rotation between the lamp base shell 116 and the lamp base locking ring 112, and lock the lamp base locking ring 112 and shell assembly 250 to the hollow light transmitting body 14. Preferably, the piercing is performed on the portion 152 and the outer ring 115, thereby preventing deformation of the threads on the lamp base shell 116 and/or the inner ring 113. The lead 24*a* is subsequently welded to the lamp base shell 116 and lead 24*b* is welded to the conductive end portion 42 of the lamp base shell 116 of the lamp base assembly 250.

Although the present invention has been described with a degree of particularity, it is the intent that the invention include all modifications and alterations falling within the spirit or scope of the appended claims.

We claim:

1. A lamp comprising:

a) a hollow light transmitting body including a light source, said body terminating in a neck, said neck being substantially circular in cross-section and having a longitudinal axis and a circumference, said neck including a keyway formed in said neck parallel to said axis and external threads about said circumference, said light transmitting body comprising first and second leads extending from the neck of said body;

b) a lamp base locking ring disposed around said circumference of said neck, said locking ring comprising an inner ring and an outer ring, said inner ring connected to said outer ring and having an indentation extending inward from said outer ring, said indentation dimensioned for receipt in said keyway for inhibiting rotative movement of said locking ring about said neck; and c) a lamp base shell having internal threads in communication with said external threads of said neck, said lamp base shell mechanically fastened to said lamp base locking ring to inhibit movement of said lamp base shell with respect to said neck, said lamp base shell having first and second electrically conductive portions, said first lead being electrically connected to said first electrically conductive portion of said shell, said second lead being electrically connected to said second electrically conductive portion of said shell.

2. The lamp of claim 1 wherein said lamp base shell is connected to said outer ring of said lamp base locking ring proximal to said indentation.

3. The lamp of claim 1 wherein said lamp base shell is mechanically connected to said outer ring by one of staking and piercing.

4. The lamp of claim 1 wherein the locking ring is preassembled to the lamp base shell prior to mounting to the body.

5. The lamp of claim 1 wherein the locking ring is rotatively preassembled to the lamp base shell prior to mounting to the body.

6. The lamp of claim 1 wherein the lamp base shell includes an enlarged diameter at one end for receiving said locking ring.

7. The lamp of claim 1 wherein said lamp base shell includes fins, said fins being bent inward for retaining said locking ring within said lamp base shell.

8. A method of securing a lamp base shell to a lamp comprising:

a) inserting a neck of said lamp having threads and a keyway into a locking ring having first and second components and an indentation on an inner portion that corresponds with said keyway;

b) threading internal threads of said lamp base shell onto said threads of said neck; and c) mechanically connecting said lamp base shell to said locking ring adjacent said indentation to inhibit movement of said lamp base shell with respect to said neck.

9. The method of claim 8 wherein said locking ring and said lamp base shell are assembled prior to assembly to said lamp, said lamp base shell includes an enlarged diameter at one end for receiving said locking ring.

10. The method of claim 8 wherein the assembly of said locking ring to said lamp base shell prior to assembly to the lamp allows rotation of said locking ring with respect to said lamp base shell.

11. The method of claim 8 wherein said lamp base shell includes fins, said fins being bent inward for retaining said locking ring within said lamp base shell.

12. A lamp, comprising:

a) a hollow light transmitting body including a light source, said body terminating in a neck, said neck being substantially circular in cross-section and having a longitudinal axis and a circumference, said neck including a keyway formed in said neck parallel to said axis and external threads about said circumference, said light transmitting body comprising first and second leads extending from the neck of said body;

b) a lamp base locking ring disposed around said circumference of said neck, said locking ring comprising an inner ring secured to an outer ring, the locking ring including an indentation extending inward from an outer diameter of said locking ring that fits into said keyway for inhibiting rotative movement of said locking ring about said neck; and c) a lamp base shell having internal threads in communication with said external threads of said neck, said lamp base shell preassembled to said lamp base locking ring prior to mounting to the body, said lamp base shell having first and second electrically conductive portions, said first lead being electrically connected to said first electrically conductive portion of said shell, said second lead being electrically connected to said second electrically conductive portion of said shell.

13. The lamp of claim 12 wherein said lamp base shell is mechanically connected to said outer ring adjacent said indentation to inhibit movement of said lamp base shell with respect to said neck.

14. The lamp of claim 13 wherein said lamp base shell is mechanically connected to said outer ring by one of staking and piercing.

15. The lamp of claim 12 wherein said lamp base shell includes fins, said fins being bent inward for retaining said locking ring within said lamp base shell.

16. The lamp of claim 12 wherein said lamp base shell is welded to said lamp base locking ring.

17. The lamp of claim 12 wherein the locking ring is rotatively preassembled to the lamp base shell prior to mounting to the body.

18. The lamp of claim 12 wherein the locking ring is rotatively connected to said lamp base shell.

* * * * *